US005988037A

United States Patent [19]

Haughom et al.

[11] Patent Number: 5,988,037

[45] Date of Patent: Nov. 23, 1999

[54] MINE CLEARING VEHICLE

[76] Inventors: Kjell Jann Haughom, 4440 Tonstad, 4440 Tonstad, Norway; Nils Magnus Østholm, P.O. Box 37, 68060 Sysslebäck, Sweden

[21] Appl. No.: 08/950,657

[22] Filed: Oct. 15, 1997

Related U.S. Application Data

[63] Continuation of application No. PCT/NO95/00046, Mar. 6, 1995, and application No. 08/702,591, Sep. 3, 1996, abandoned.

[30] Foreign Application Priority Data

Mar. 7, 1994 [NO] Norway ..... 940783

[51] Int. Cl.[6] ..... F41H 11/16

[52] U.S. Cl. ..... 89/1.13; 172/112; 172/120; 172/122; 172/548; 172/554

[58] Field of Search ..... 89/1.13; 404/132; 172/112, 119, 118, 120, 122, 123, 554, 555, 544, 548

[56] References Cited

U.S. PATENT DOCUMENTS

| | | | |
|---|---|---|---|
| 3,136,078 | 6/1964 | Renault | 404/132 |
| 3,236,312 | 2/1966 | Vivas | 172/119 |
| 3,570,604 | 3/1971 | Allard et al. | 172/123 |
| 4,704,045 | 11/1987 | Taylor et al. | 172/122 |
| 4,765,221 | 8/1988 | Sombrowski | 89/1.13 |

FOREIGN PATENT DOCUMENTS

| | | | |
|---|---|---|---|
| 326368 | 8/1989 | European Pat. Off. . | |
| 397551 | 11/1990 | European Pat. Off. . | |
| 2052900 | 5/1972 | Germany | 89/1.13 |
| 2318055 | 10/1974 | Germany | 89/1.13 |
| 2430709 | 1/1976 | Germany . | |
| 2721041 | 11/1978 | Germany | 172/123 |
| 3127856 | 2/1983 | Germany | 89/1.13 |
| 3127856 | 10/1988 | Germany . | |

*Primary Examiner*—Stephen M. Johnson
*Attorney, Agent, or Firm*—Andrus, Sceales, Starke & Sawall

[57] ABSTRACT

A mine clearing vehicle (1) having a milling cutter drum (2) adapted to tear up soil, plant parts, mines, etc. on or within the top soil layer. The milling cutter drum (2) may advantageously be divided into discs (7) provided with teeth (8).

5 Claims, 3 Drawing Sheets

MINE CLEARING VEHICLE

The present application is a continuation of PCT/NO95/00046 filed Mar. 6, 1995, a continuation of application Ser. No. 08/702,591, filed Sep. 3, 1996, now abandoned.

BACKGROUND OF THE INVENTION

SUMMARY OF THE INVENTION

The invention relates to a mine clearing vehicle.

At war or when war menaces, land areas are often mined to prevent or delay the advance of the enemy. Mining is also used as a terror weapon against the civil population.

A military unit advancing over a mined area, tries to reduce losses by clearing passages of mines and then advancing along the passages. A known manner to effect mine clearing is first to localize mines by means of known equipment for mine searching and, thereafter, either to detonate or disarm and neutralize them. Another known way to effect mine clearing is to load the ground by means of a mine clearing vehicle in order to make possible hidden mines to detonate. The ground can be loaded by means of movable lugs, claws or drums thumping against the ground in front of the mine clearing vehicle. Another known solution is to provide a mine clearing vehicle with a horizontal rotary shaft to which is attached sections of chain being hurled against the ground in front of the mine clearing vehicle. Equipment of this kind is, of course, built in order to withstand mine explosions and to protect the driver.

As long as a war situation prevails, mine fields are seldom completely cleared; it is common that areas remain mined. Years after the conflict is over, they may lie fallow. When after a long time it becomes necessary to clear an area of mines, the area is often overgrown with bushes and smaller trees. An area which for many years has been impossible to use for e.g. agriculture because of mines, often remains unused after mine clearing because the area is overgrown. Overgrowth gives reduced passable conditions and makes, moreover, the mine clearing difficult, either the mines are to be searched and localized or detonated by means of a mine clearing vehicle of a kind known in the art. Overgrowth can to a certain degree shield mines from mine clearing vehicle and prevent mines to be detonated.

The object of the invention is to provide a mine clearing vehicle which can neutralize mines, especially in overgrown areas. Also, it is an object that the mine clearing vehicle shall increase the value of use of a mine cleared area through a cultivating effect on the soil and removal of plants in the area concerned.

The objects are achieved through features as defined in the following claims.

BRIEF DESCRIPTION OF THE DRAWING

An example of an embodiment of the invention is described with reference to the attached drawings, in which.

DETAILED DESCRIPTION OF THE PREFERRED EMBODIMENTS

Figure 1:
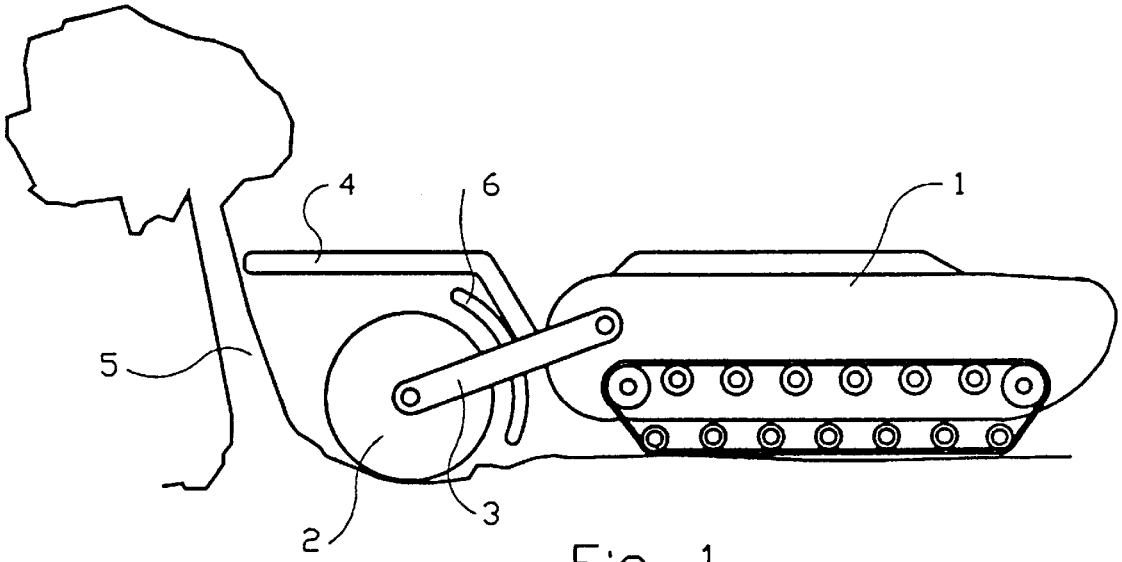
FIG. 1 shows diagrammatically and seen from the side a caterpillar mine clearing vehicle having a milling cutter drum mounted in front of the vehicle.
Figure 2:
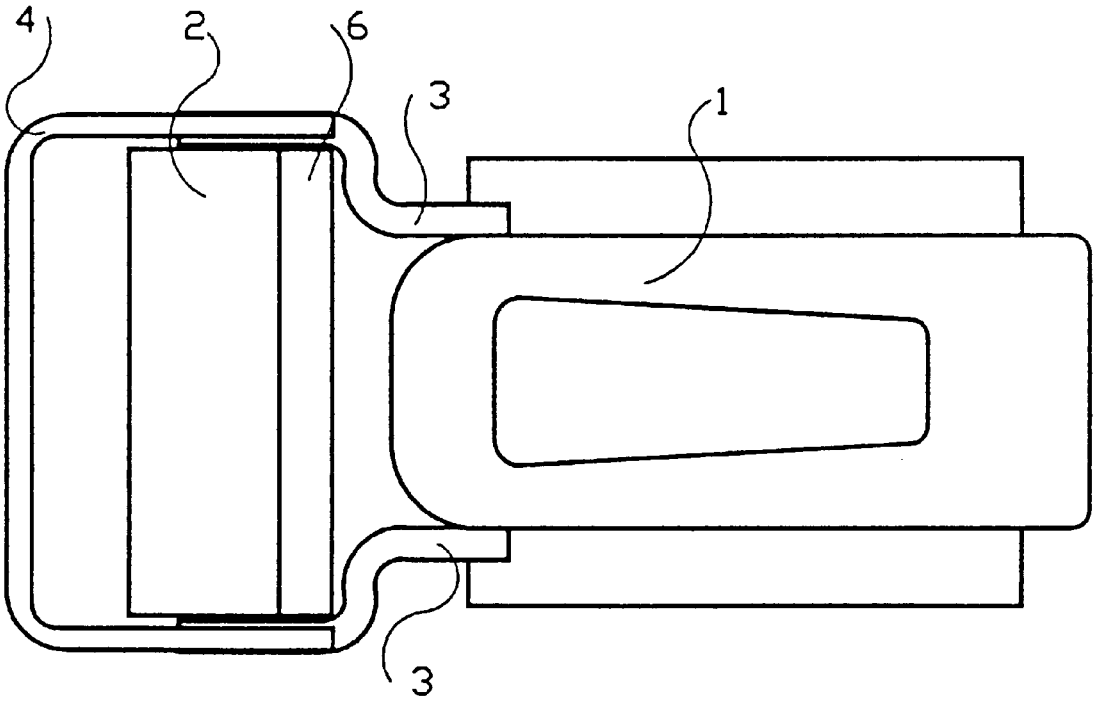
FIG. 2 shows diagrammatically and seen from above the same mine clearing vehicle as in FIG. 1.

In FIG. 1, reference numeral 1 denotes a mine clearing vehicle having a rotary milling cutter drum 2 attached to the mine clearing vehicle 1 with arms 3 assigned a hydraulic power system, not shown, for lifting and lowering the milling cutter drum 2. A hoop 4 is adapted to push against larger plants, e.g. a tree 5, in front of the milling cutter drum 2, such that the milling cutter drum 2 hits the tree 5 close to the root. A shield 6 intercepts soil and stones hurled out from the rear edge of the milling cutter drum 2.

The mine clearing vehicle 1 advances the milling cutter drum 2 with a working depth equal to a few centimeters to typically thirty to fifty centimeters down into the ground, simultaneously as the drum 2 is rotated with a periphery speed of eight to twenty meters per second. Buried mines could explode when they are hit by the milling cutter drum 2. However, experiments have shown that the milling cutter drum 2 often damages the mine, and that the detonating composition of the mine is torn loose before it can activate the mine charge. The milling cutter drum 2 is provided with shares or teeth, preferably with a point of hard metal or the like, and soil, roots and mines are chopped to form a top soil layer which, thus, is cultivated and easy to clear of logs and larger branches. A tree 5 will be bent forwardly by means of the hoop 4 and cut near the root. The tree 5 will fall forwardly and, thereafter, be chopped by the milling cutter drum 2. The tree 5 will be pulled rearwardly and in beneath the mine clearing vehicle. Possible remainders from the tree 5 can easily be removed when the area has been cleared of mines.

Figure 3:
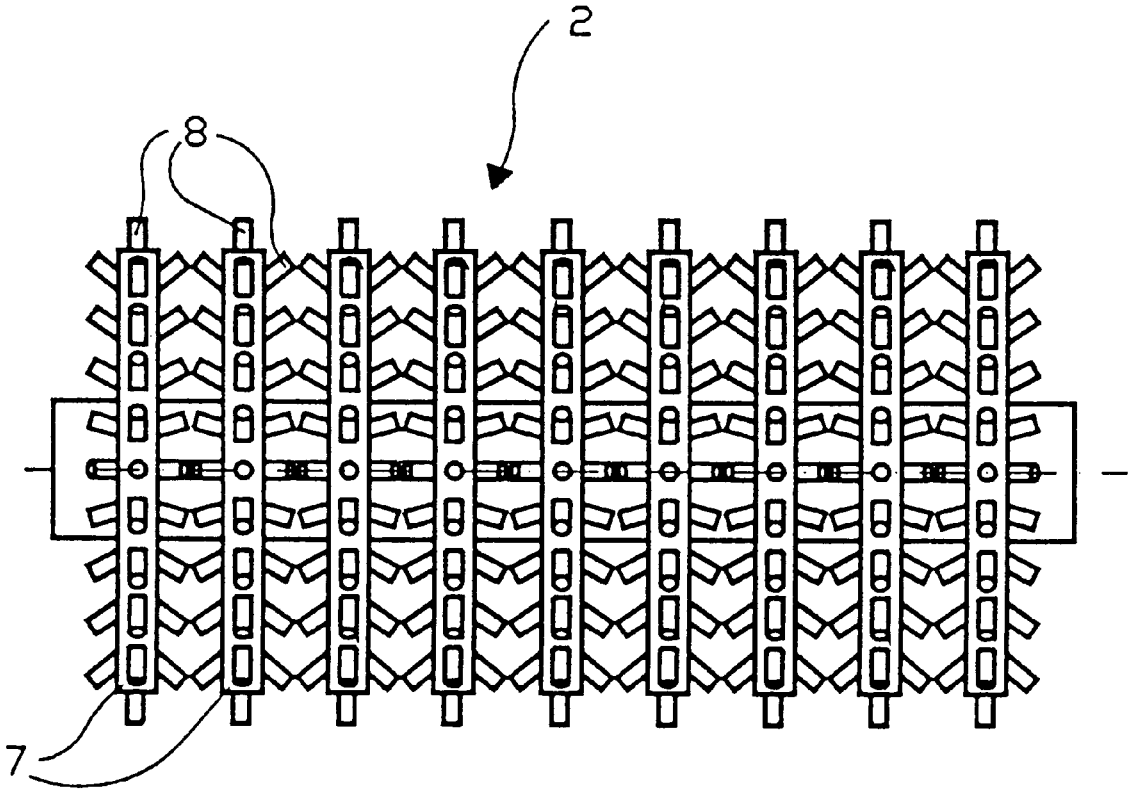
FIG. 3 shows seen from above and on a larger scale a milling cutter drum divided into discs.

The milling cutter drum 2 may advantageously be divided into discs 7 provided with teeth 8 such as shown in FIG. 3. A milling cutter disc 2 built up by means of discs 7, constitutes less air resistance for detonating mines and is, therefore, more resistive. The shield 6 may also be formed in perforated plate or as a grid, so that air pressure from mine explosions will not be damaging.

The mine clearing vehicle 1 may have a driver of its own, or it may be remote-controlled. The milling cutter drum 2 may be attached to the mine clearing vehicle 1 in many ways.

We claim:

1. Apparatus for clearing land mines from below the surface of soil overgrown with vegetation and for rendering land cleared of mines suitable for agriculture or other use, said apparatus being mountable on a blast resistant vehicle that moves over the land along a line of movement, said apparatus comprising:

at least one cylindrically shaped cutter member positionable ahead of the vehicle so as to precede the vehicle as the vehicle moves along the line of movement, said cutter member being rotatable about an axis normal to the line of movement of the vehicle;

drive means for driving the cutter member to rotate about the axis of the member independently of any movement of the vehicle, said cutter member being driven at a peripheral speed of from 8 to 20 meters per second;

means for mounting said cutter member on the front of the vehicle to lower the exterior of said rotating cutter member into the soil ahead of the vehicle to destroy the land mines and comminute vegetation into the soil as the vehicle moves along the line of movement;

said cutter member being formed of a plurality of disks lying normal to the axis of said cutter member and spaced along the axis of the cutter member, the peripheries of said disks forming the exterior of said member, each of said disks of said cutter member having a plurality of cutting teeth circumferentially spaced along the periphery of the disk, certain of said teeth of each of said disks extending laterally from the disk toward an adjacent disk and into contiguity with similarly extending teeth of the adjacent disk so that the cutter member engages substantially the entirety of the swath of soil traversed by the cutter member during movement of the vehicle; and a shield interposable between said cutter member and the front of the vehicle for protecting the latter from debris discharged from said cutter member.

2. The mine clearing vehicle as set forth in claim 1 wherein the shield is formed as a perforated plate, such that air pressure from a mine explosion passes through the perforated plate to reduce the possibility of damage to the shield.

3. The mine clearing vehicle as set forth in claim 1 wherein the plurality of individual discs of the cutter drum are joined by a connecting shaft, such that the air gap between the plurality of individual discs reduces the air resistance of the cutter drum to reduce the possibility of damage to the cutter drum upon a mine explosion.

4. The mine clearing vehicle as set forth in claim 1 further comprising a hoop extending over said cutter member for positioning a rigid bar above said cutter member and ahead of said cutter member in the line of movement of the vehicle, said bar lying generally transverse to the line of movement of the vehicle for engaging arboreal vegetation when the vehicle moves over the land, said bar deflecting the arboreal vegetation so that said rotating cutter drum contacts the arboreal vegetation adjacent its roots to fell the arboreal vegetation.

5. Apparatus for clearing land mines from below the surface of soil overgrown with arboreal vegetation and for felling the arboreal vegetation to render land cleared of mines suitable for agriculture or other use, said apparatus being mountable on a blast resistant vehicle that traverses the land along a line of movement, said apparatus comprising:

at least one cylindrically shaped cutter member positionable ahead of the vehicle so as to precede the vehicle as the vehicle moves along the line of movement, said member being rotatable about an axis normal to the line of movement of the vehicle, said cutter member being formed of a plurality of disks spaced along the axis of the member, each of said disks having a plurality of peripheral cutting teeth;

drive means for rotating said cutter member about said axis of said member independently of any movement of the vehicle;

means for mounting said cutter member on the front of the vehicle to lower said driven cutter member into the soil ahead of the vehicle to destroy the land mines and comminute vegetation into the soil as the vehicle moves along the line of movement;

a shield interposed between said cutter member and the front of the vehicle for protecting the latter from debris discharged from said cutter member; and a hoop extending over said cutter member for positioning a rigid bar above said cutter member and ahead of said cutter member in the line of movement of said vehicle, said bar lying generally transverse to the line of movement of the vehicle for engaging arboreal vegetation when the vehicle moves over the land, said bar deflecting the arboreal vegetation and being positioned with respect to said cutter member such that said driven cutter member contacts the arboreal vegetation adjacent its roots to fell the arboreal vegetation.

* * * * *